US005282514A

United States Patent [19]

Felcetto

[11] Patent Number: 5,282,514

[45] Date of Patent: Feb. 1, 1994

[54] WINDOW GUARD FOR VENETIAN BLIND HUNG WINDOWS

[76] Inventor: Roy P. Felcetto, 254 W. 25th St., New York, N.Y. 10001

[21] Appl. No.: 883,167

[22] Filed: May 15, 1992

[51] Int. Cl.[5] ..... E06B 9/30; E06B 9/26

[52] U.S. Cl. ..... 160/178.1; 49/90; 160/172; 160/175

[58] Field of Search ..... 160/178.1, 172, 175; 49/90

[56] References Cited

U.S. PATENT DOCUMENTS

| | | | |
|---|---|---|---|
| 2,205,156 | 6/1940 | Rowley | 160/175 X |
| 2,299,095 | 10/1942 | Knox | 160/172 |
| 2,523,392 | 9/1950 | Rabinowitz et al. | 160/172 |
| 3,853,169 | 12/1974 | Music et al. | 160/172 |

*Primary Examiner*—Philip C. Kannan

*Attorney, Agent, or Firm*—Ostrager, Chong & Flaherty

[57] ABSTRACT

A window guard for a venetian blind hung window consisting of oppositely disposed sleeves, the sleeves being adapted to be affixed to opposite ends of a window frame, each sleeve containing a rotator extending substantially the length of the sleeve to form an assemblage, each sleeve and rotator being slotted along their lengths, said slots permitting the slats of a venetian blind to extend within the assemblages and move reciprocally and pivotably therein, each rotator having a series of equally spaced extensions which, upon selective rotation of the rotator, prevents reciprocable and/or pivotable movement of the blind.

4 Claims, 1 Drawing Sheet

WINDOW GUARD FOR VENETIAN BLIND HUNG WINDOWS

This invention relates to window guards and particularly to window guards for venetian blind hung windows.

INTRODUCTION

While there have been proposals set forth for using a venetian blind as a window guard such proposals have been deficient in important respects and thus the conception has never realized its full potential.

It is therefor amongst the important objects of the present invention to provide a mechanism for utilizing a venetian blind as a window guard.

It is another important object of the present invention to provide a guard which will not only impede the reciprocal movement of a venetian blind but will also impede its pivoting capability.

It is yet another object of the present invention to provide such a mechanism which is easy to operate and install and inexpensive to manufacture.

It is still another important object of the present invention to provide a mechanism which will prevent venetian blinds from rattling in the wind.

SUMMARY OF THE INVENTION

These and other objects are realized by a window guard consisting of oppositely disposed sleeves, the sleeves being adapted to be affixed to opposite ends of a window frame, each sleeve containing a rotator extending substantially the length of the sleeve to form a assemblage, each sleeve and rotator being slotted along their lengths, said slots permitting the slats of a venetian blind to extend within the assemblages and move reciprocally and pivotably therein, each rotator having a series of equally spaced extensions which, upon selective rotation of the rotator, prevents reciprocable and/or pivotable movement of the blind.

Other objects and advantages of the present invention will become apparent from a reading of the following specification taken in connection with the accompanying drawing wherein:

DETAILED DESCRIPTION OF THE VIEWS OF THE DRAWING

Figure 1:
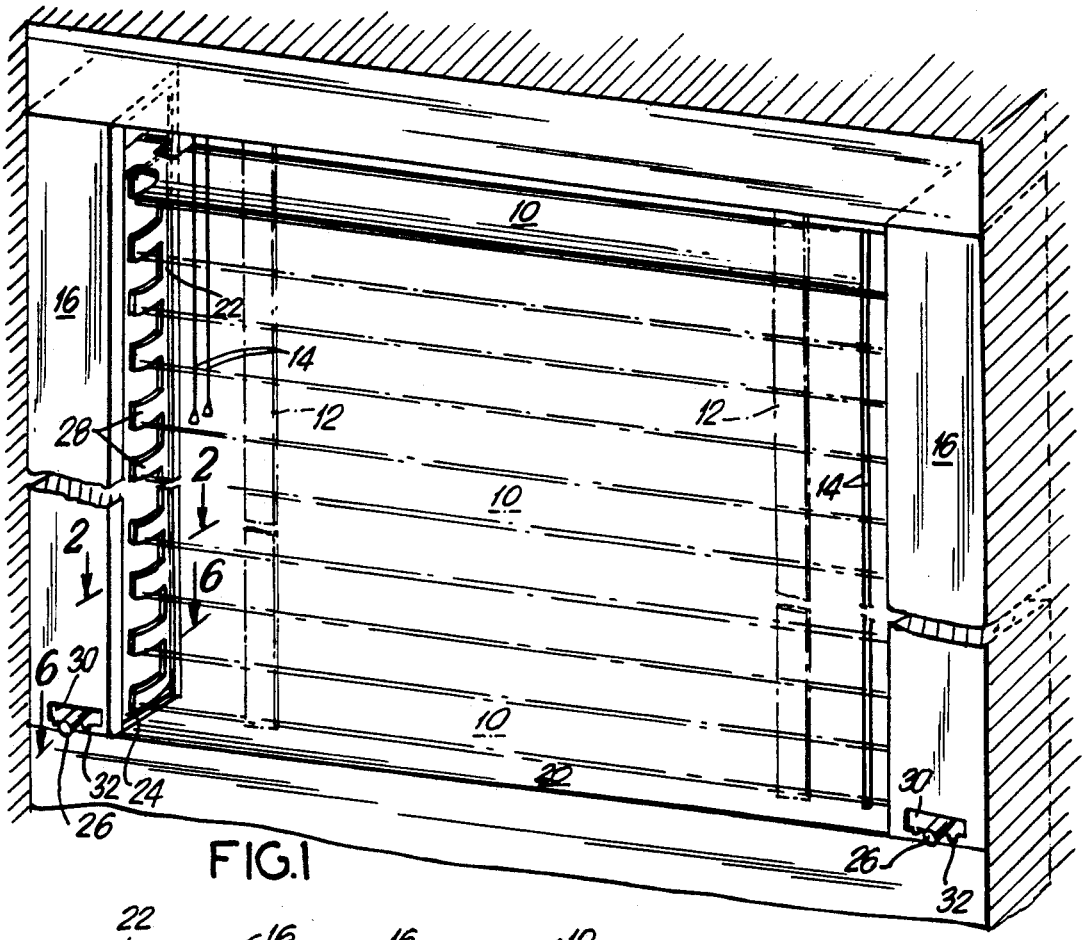
FIG. 1 is a perspective view of one embodiment of guard in accordance with the present invention.
Figure 2:
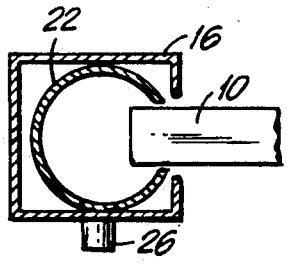
FIG. 2 is a fragmentary view taken through section 2—2 of FIG. 1.

Before explaining the invention in detail it is to be understood that the invention is not limited in its application to the details of construction and arrangement of parts illustrated in the drawings since the invention is capable of other embodiments and of being practiced or carried out in various ways. It is also to be understood that the phraseology or terminology employed is for the purpose of description and not of limitation.

Referring to the drawing wherein similar reference characters designate corresponding parts throughout the several views, 10 designates the slats of a conventional venetian blind provided with the usual tapes 12 and cord 14 for raising the blind and/or tilting the slats. This invention teaches the provision of rectangular sleeves 16 on either side of the window frame 20.

As may be seen in FIG. 1, the sleeves run substantially the length of the window frame. Positioned within each sleeve is a rotatable member which shall be hereinafter referred to as rotator 22. The rotators also run substantially the length of their respective sleeves.

Each rotator 22 is essentially circular in shape and is provided with a slot (not visible in the drawing) running along its length.

Likewise, each sleeve is provided with a slot 24 running along its length. The slats of the venetian blind may extend into these slots when the slots of the sleeve and the rotator are in complete registry and when so positioned the slats can readily be moved upwards and downwards and tilted. Each rotator is provided with a lever 26 so that it may be rotated from inside the room. Horizontal slots 30 are formed in each sleeve permitting lever 26 to extend outwardly of the sleeve and also, permitting the lever to travel horizontally. Each slot is notched as at 32 for reasons hereinafter appearing.

Figure 3:
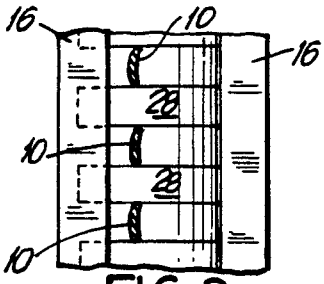
FIG. 3 is a fragmentary view showing another position of slat with rotator.
Figure 4:
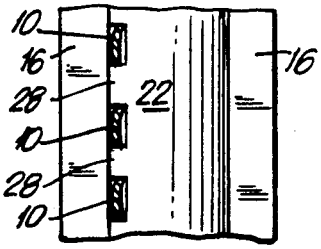
FIG. 4 is still another fragmentary view showing still another position of slat with rotator.
Figure 5:
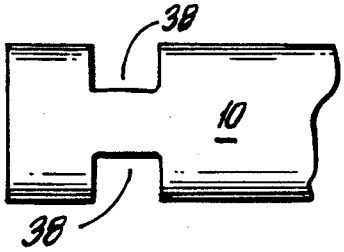
FIG. 5 is a fragmentary view of one end of an embodiment of slat specifically adapted for the mechanism of the present invention.
Figure 6:
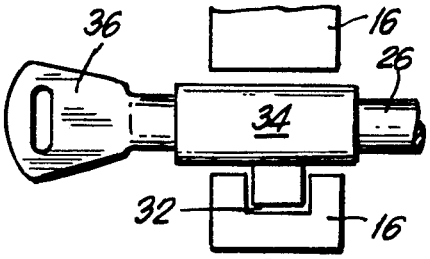
FIG. 6 is a fragmentary view taken through line 6—6 of FIG. 1 showing means for locking the rotator.

Each rotatable member is provided with a series of extensions which form a series of horizontal abutments 28. When the rotator is moved so that the abutments are in line with the slot formed in the sleeve the slats will be located in the spaces formed by the abutments. In this position the slats may not be moved reciprocally (upwardly or downwardly) and may not even be tiltable depending upon the amount of rotation of the rotator. This may be seen in FIGS. 3 and 4. In the position of the rotator shown in FIG. 3 the slats cannot be moved reciprocally while in the position of the rotator shown in FIG. 4 the slats cannot be moved in any respect. They are completely locked in position. Slats 10 may be notched as at 36, as is shown in FIG. 5, to enhance the locking of the slat within the sleeve. Lever 26 contains a locking mechanism 34 permitting the movement of the rotator only when unlocked by key 36. When the key is turned in the locking mechanism an extension from the locking mechanism moves into notch 32 preventing further movement of the rotator. A series of such notches may be s provided to allow the rotator to be locked in a variety of positions.

It should be realized that the embodiments herein described are only representative of the invention and it is not intended to limit the invention to these particular embodiments as the invention encompasses all embodiments falling with the spirit and scope of the appended claims.

I claim:

1. A window guard for a venetian blind hung window comprising oppositely disposed sleeves, said sleeves being adapted to be affixed to opposite ends of a window frame, each sleeve containing a rotator extending substantially the length of the sleeve to form an assemblage, each sleeve and rotator being slotted along their lengths, said slots permitting the slats of a venetian blind to extend within the assemblages and move reciprocally and pivotably therein, each rotator having a series of equally spaced abutments which extend into its slot and upon rotation of the rotator selectively prevents reciprocable and pivotable movement of the blind by blocking the movement of its slats.

2. A window guard for a venetian blind hung window comprising oppositely disposed sleeves, said sleeves being adapted to be affixed to opposite ends of a window frame, each sleeve containing a tubular rotator extending substantially the length of the sleeve to form an assemblage, each sleeve and rotator being slotted along their lengths, said slots permitting the slats of a venetian blind to extend within the assemblages and move reciprocally and pivotably therein, each rotator having a series of equally spaced abutments which extend into its slot and are aligned with the slot of the sleeve permitting, in a first position, the slats to be trapped between adjacent abutments preventing reciprocable movement, and in a second position, the abutments are moved almost clear of the slot to clamp the slats between the rotator and the sleeve as well as between adjacent abutments to prevent any movement whatsoever of the blind.

3. A window guard in accordance with claim 2 where locking means are provided to lock the rotator in any of its positions so it and the blind clamped thereby cannot be moved.

4. A window guard for a venetian blind hung window comprising oppositely disposed sleeves, said sleeves being adapted to be affixed to opposite ends of a window frame, each sleeve containing a tubular rotator extending substantially the length of the sleeve to form an assemblage, each sleeve and rotator being slotted along their lengths, said slots permitting the slats of a venetian blind to extend within the assemblages and move reciprocally and pivotably therein, each rotator having a series of equally spaced abutments which extend into its slot and are aligned with the slot of the sleeve permitting, in a first position, the slats to be trapped between adjacent abutments preventing reciprocable movement, and in a second position, the abutments are moved almost clear of the slot to clamp the slats between the rotator and the sleeve as well as between adjacent abutments to prevent any movement whatsoever of the blind, said rotator having a rod extending therefrom, said rod extending through a slot in the sleeve to communicate with the exterior, the periphery of the wall forming said slot being recessed at at least two points, said rod moving along the slot as the rotator turns, a lock cylinder having a movable extension therein housed within the rod, said extension moving into one of the recesses when released by a key to lock the rotator in position.

* * * * *